US007484393B2

(12) United States Patent
Tomizawa

(10) Patent No.: US 7,484,393 B2
(45) Date of Patent: Feb. 3, 2009

(54) PROFILE MOTHER PIPE FOR HYDRAULIC BULGING, HYDRAULIC BULGING APPARATUS USING THE SAME, HYDRAULIC BULGING METHOD, AND HYDRAULIC BULGED PRODUCT

(75) Inventor: Atsushi Tomizawa, Minoo (JP)

(73) Assignees: Sumitomo Metal Industries, Ltd., Osaka (JP); Sumitomo Pipe & Tube Co., Ltd., Ibaraki (JP)

( * ) Notice: Subject to any disclaimer, the term of this patent is extended or adjusted under 35 U.S.C. 154(b) by 90 days.

(21) Appl. No.: 11/488,675

(22) Filed: Jul. 19, 2006

(65) Prior Publication Data

US 2008/0011382 A1 Jan. 17, 2008

Related U.S. Application Data

(63) Continuation of application No. PCT/JP2004/000507, filed on Jan. 21, 2004.

(51) Int. Cl.
*B21D 22/26* (2006.01)
*B21D 39/20* (2006.01)

(52) U.S. Cl. ..... 72/57; 72/58; 72/62; 72/370.22; 29/421.1

(58) Field of Classification Search ..... 72/57, 72/58, 61, 62, 370.22; 29/421.1
See application file for complete search history.

(56) References Cited

U.S. PATENT DOCUMENTS 5,203,190 A * 4/1993 Kramer et al. ..... 72/62
5,419,791 A * 5/1995 Folmer ..... 72/57
6,006,567 A * 12/1999 Brown et al. ..... 72/62
6,182,487 B1 * 2/2001 Komiya et al. ..... 29/421.1
6,216,509 B1 * 4/2001 Lotspaih et al. ..... 72/61
6,266,986 B1 * 7/2001 Morita et al. ..... 72/58
6,941,786 B1 * 9/2005 Cooper et al. ..... 72/57

FOREIGN PATENT DOCUMENTS

| | | |
|---|---|---|
| JP | 55-154616 | 4/1954 |
| JP | 52-073168 | 6/1977 |
| JP | 57-165134 | 10/1982 |
| JP | 62-199232 | 9/1987 |
| JP | 2000-045767 | 2/2000 |
| JP | 2000-301249 | 10/2000 |
| JP | 2001-321842 | 11/2001 |
| JP | 2002-509487 | 3/2002 |
| JP | 2003-001336 | 1/2003 |
| WO | WO 98/51428 | 11/1998 |

* cited by examiner

*Primary Examiner*—David B Jones
(74) *Attorney, Agent, or Firm*—Clark & Brody

(57) ABSTRACT

A profile mother pipe for hydraulic bulging of the present invention has a peripheral length whose outer diameter is gradually increased or decreased from one end to the other end in an axial direction. In the profile mother pipe, a holding portion whose peripheral length is increased toward a pipe end face on one end side can be formed on at least one end side and a parallel portion can be formed on the other end side where the holding portion is not formed. In a working apparatus and method in which the profile mother pipe is used, pressing working can be performed from the pipe end toward the axial direction, even in use of the profile mother pipe whose sectional shape is largely varied in the axial direction. Therefore, an expansion ratio larger than ever before can be obtained in a hydraulic bulged product to which hydraulic bulging is performed.

20 Claims, 10 Drawing Sheets

PROFILE MOTHER PIPE FOR HYDRAULIC BULGING, HYDRAULIC BULGING APPARATUS USING THE SAME, HYDRAULIC BULGING METHOD, AND HYDRAULIC BULGED PRODUCT

CROSS REFERENCE TO RELATED APPLICATION

This application is a continuation of International Patent Application No. PCT/JP2004/000507, filed Jan. 21, 2004. This PCT application was not in English as published under PCT Article 21(2).

TECHNICAL FIELD

The present invention relates to a profile mother pipe used for hydraulic bulging, a hydraulic bulging apparatus which performs the hydraulic bulging with the profile mother pipe, a hydraulic bulging method, and a hydraulic bulged product to which the hydraulic bulging is performed.

BACKGROUND ART

The hydraulic bulging has many features compared with other forming methods. For example, a component having a complicated shape in which a sectional shape is varied in a longitudinal direction can be produced by the hydraulic bulging, so that a mechanical component in which welding is required in the conventional technique can be produced by integral forming. In the hydraulic bulging, work hardening is generated in the whole of the produced component, so that high-strength product can be obtained even if the mild mother pipe is used.

Furthermore, little springback is generated after the hydraulic bulging, and good dimensional accuracy is obtained in the product (good shape fixability). Therefore, a process of adjusting the product dimension is not required, and the process can be streamlined.

Recently, the above excellent features of the hydraulic bulging are highly regarded and the hydraulic bulging is particularly being adopted as a method of producing automobile components.

FIG. 1 is a view explaining the conventional hydraulic bulging in which a straight pipe is used, FIG. 1A shows a pre-hydraulic bulging sectional configuration, and FIG. 1B shows a post-hydraulic bulging sectional configuration.

In the hydraulic bulging in which a general straight pipe is used, as shown in FIG. 1A, a working fluid is injected through an injection hole 3 into a mother pipe P1 set in a pair of upper and lower dies 1 and 2, and pressing working is performed from both pipe ends toward an axial direction by axial pressing tools (hereinafter referred to as "sealing tool") 4 and 5 which are also used as a sealing tool, while working fluid pressure (hereinafter referred to as "inner pressure") is increased. This enables a product P2 having a sectional shape shown in FIG. 1B to be produced.

During the hydraulic bulging, the sealing tools 4 and 5 are connected to a hydraulic cylinder (not shown) to control a position in an axial direction or axial pressing force.

In the hydraulic bulging, it is said that axial pressing working in the axial direction to be applied from a pipe end is an extremely important working step, because the axial pressing working promotes a metal flow during expansion to improve an expansion limit.

That is, in the hydraulic bulging, a pipe wall thickness is remarkably decreased according to the expansion of the material, only when the internal pressure is simply applied while the positions in the axial direction of both end portions of the mother pipe is fixed without performing the axial pressing working from the pipe end. Therefore, fracture is generated in the midway of the hydraulic bulging, and a formable range (expansion limit) is restricted.

In the hydraulic bulging, there is another problem caused by a shape of the mother pipe. As described above, one of the features of the hydraulic bulging is that the complicated shape in which the sectional shape is varied in the axial direction can be produced by the hydraulic bulging. However, there is a limitation in the work shape obtained by the conventional hydraulic bulging.

For example, a peripheral length increasing rate (expansion ratio is defined as peripheral length increasing rate (expansion ratio)={(outer peripheral length of the instant portion of the workpiece/circumferential length of mother pipe)−1}×100%, depending on shape characteristics necessary for the working product and mother pipe conditions (material grade and pipe wall thickness) to be used, the peripheral length increasing rate (expansion ratio) is about 25% at most except for the pipe end portion area where the axial pressing is effective.

That is, further elaboration is required in order to increase a degree of freedom of the product shape design and to obtain the product having the further complicated, arbitrary sectional shape.

In order to solve the problem, instead of the straight mother pipe, there is proposed the use of a substantially conical mother pipe (hereinafter referred to as "tapered mother pipe") having a peripheral length in which an outer diameter is gradually increased or decreased from one end to the other end in the axial direction.

Specifically, when the tapered mother pipe is used, the peripheral length increasing rate associated with the hydraulic bulging can be suppressed to a lower level to form a predetermined work shape, even in the component in which the forming is hardly performed using the straight mother pipe, e.g., the component in which the peripheral length is largely varied along the axial direction (for example, see FIG. 2 in page 1 of Japanese Patent Application Publication No. 2001-321842).

However, in the case where the hydraulic bulging is performed with the tapered mother pipe in which the sectional shape is varied in the axial direction, it is difficult that the axial pressing is performed to the tapered mother pipe using the sealing tool for the straight mother pipe shown in FIG. 1.

FIG. 2 is a view explaining a problem generated in the case where the axial pressing is performed to the tapered mother pipe with a conventional straight mother pipe axial pressing tool. As shown in FIG. 2, on the large-diameter end side, the axial pressing cannot be performed to the tapered mother pipe TP1. On the small-diameter end side, the axial pressing can be performed to the tapered mother pipe TP1. However, as the axial pressing tool 4 intrudes in the upper and lower dies 1, 2 in association with the axial pressing, constraint of inner and outer surfaces of the tapered mother pipe TP1 becomes insufficient on the side of the axial pressing tool 4, which results in generation of sealing leakage.

FIG. 3 is a view explaining a hydraulic bulging process with the conventional tapered mother pipe, FIG. 3A shows a sectional configuration in which the tapered mother pipe which is of the starting material is set prior to the forming, FIG. 3B shows a pre-hydraulic bulging sectional configuration in which a profile mother pipe for hydraulic bulging is formed, and FIG. 3C shows a sectional configuration when the hydraulic bulging finishes.

In the conventional hydraulic bulging in which the tapered mother pipe TP1 is used, sealing tools 6 and 7 whose front-end portions are tapered are used as shown in FIG. 3. However, usually the hydraulic bulging is completed only with the internal pressure load because the axial pressing cannot be performed. In FIG. 3, the symbol TP2 designates a tapered mother pipe after the pipe end portion is formed, and the symbol TP3 designates a product (hydraulic bulged product) after the hydraulic bulging.

In the hydraulic bulging process shown in FIG. 3, because the axial pressing cannot be performed to the tapered mother pipe TP2, as described above, the working can be performed within a limited forming range where the fracture is not generated in the hydraulic bulging stage. Accordingly, in the hydraulic bulging, currently the effect generated by the use of the tapered mother pipe is not sufficiently exerted.

Therefore, in the case where the hydraulic bulging is performed using the tapered mother pipe, there is demanded a technological development in which the axial pressing can be performed from the pipe end toward the axial direction in addition to the internal pressure load on the mother pipe.

DISCLOSURE OF THE INVENTION

In view of the foregoing, it is an object of the present invention to provide a profile mother pipe for hydraulic bulging in which, in addition to the internal pressure load on the mother pipe, the axial pressing can be performed from the pipe end toward the axial direction to obtain the large expansion ratio, a hydraulic bulging apparatus using the same, a hydraulic bulging method, and a hydraulic bulged product.

The invention is made in order to achieve the above object, and main parts of the invention includes (1) profile mother pipe for hydraulic bulging, (2) hydraulic bulging apparatus, (3) hydraulic bulging method, and (4) hydraulic bulged product.

(1) A first aspect of the invention is a profile mother pipe for hydraulic bulging wherein the profile mother pipe for hydraulic bulging has a peripheral length whose outer diameter is gradually increased or decreased from one end to the other end in an axial direction, and a holding portion is formed on at least one end side(hereinafter, referred to as "a first end side"), the peripheral length being increased toward a pipe end face on the first end side in the holding portion.

However, in order to secure the sealing characteristics, a rate of the increase in peripheral length of the holding portion should be larger than a rate of the increase in peripheral length of a mother pipe main portion when the holding portion is formed on a large-diameter end side.

In the profile mother pipe for hydraulic bulging of the invention, it is preferable that a parallel portion be formed on the other end side (hereinafter, referred to as "a second end side"), when the holding portion is formed on the first end side while not formed on the second end side. This is because the axial pressing can be performed with the simple structure from the end side on which the parallel portion is formed. The sealing characteristics of the end portion can also be improved by forming the parallel portion.

(2) A second aspect of the invention is a hydraulic bulging apparatus containing the following "first working apparatus to fourth working apparatus." As described above, "sealing tool" shall mean the axial pressing tool which is also used as the sealing tool.

As shown in FIGS. 5 and 6, "first working apparatus" is a hydraulic bulging apparatus for performing axial pressing working to the profile mother pipe from the first end side where the holding portion is formed, the hydraulic bulging apparatus including: a pair of die main bodies; a pair of pipe end holding dies which is arranged on the first end side of the die main body; a first sealing tool whose front-end portion is inserted into the pipe end holding die in order to hold an end portion on the first end side of the profile mother pipe while coupled with the pipe end holding die; a second sealing tool whose front-end portion is inserted into the die main body in order to hold an end portion on the second end side of the profile mother pipe while coupled with the die main body; and at least one thrust member which is provided between the die main body and the pipe end holding die, the thrust member imparting thrust force to the pipe end holding die after at least a working fluid is injected, the thrust force facing an end portion of the die main body, the hydraulic bulging apparatus being wherein an injection hole of the working fluid is made in either the first sealing tool or the second sealing tool and, during the hydraulic bulging, the pipe end holding die is moved against the thrust force of the thrust member as the first sealing tool holding the end portion on the first end side of the profile mother pipe is moved in the axial direction.

As shown in FIGS. 8 and 9, "second working apparatus" is a hydraulic bulging apparatus for performing axial pressing working to the profile mother pipe from at least the first end side, the holding portion being formed on the first end side while the parallel portion being formed on the second end side in the profile mother pipe, the hydraulic bulging apparatus characterized in that, in the configuration adopted for the "first working apparatus," a parallel portion is provided in an inner surface of the end portion on the second end side in the pair of die main bodies, the inner surface of the end portion corresponding to a parallel portion of the profile mother pipe, and a parallel portion is provided in an outer surface corresponding to the parallel portion of the profile mother pipe in order to hold an end portion on the second end side of the profile mother pipe while coupled with the parallel portion of the die main body.

In "second working apparatus," the axial pressing can also be performed from the second end side of the profile mother pipe by adopting the above configuration. Even if the axial pressing is not performed, the sealing characteristics can be improved by forming the parallel portion in the end portion on the second end side.

As shown in FIG. 10, "third working apparatus" is a hydraulic bulging apparatus for performing axial pressing working to the profile mother pipe from both end sides where the holding portions are formed, comprising a pair of pipe end holding dies, sealing tools, and an thrust member imparting the thrust force in each of the end portions on the first and second end side of the profile mother pipe in the die main body.

"First working apparatus" includes the pair of pipe end holding dies, the sealing tool, and the thrust member imparting the thrust force on the first end side of the die main body. On the other hand, "third working apparatus" including the same configuration on both the end sides of the die main body.

As shown in FIG. 11, "fourth working apparatus" is a hydraulic bulging apparatus wherein at least a set of a pair of intermediate holding dies and an thrust member imparting the thrust force to the pair of intermediate holding dies is sequentially arranged between the thrust member imparting the thrust force to the pair of pipe end holding dies and the pair of die main bodies.

(3) A third aspect of the invention is a hydraulic bulging method wherein the profile mother pipe described in (1) is set in a die of the hydraulic bulging apparatus in any one of "first working apparatus to fourth working apparatus," and hydraulic bulging in which an internal pressure load and axial pressing are combined is performed to the profile mother pipe.

Further, a third aspect of the invention is a hydraulic bulging method wherein the profile mother pipe described in (1) is produced using the hydraulic bulging apparatus in any one of "first working apparatus to fourth working apparatus," and hydraulic bulging in which an internal pressure load and axial pressing are combined is performed to the profile mother pipe.

(4) A fourth aspect of the invention is a hydraulic bulged product wherein the profile mother pipe described in (1) is set in a die of the hydraulic bulging apparatus in any one of "first working apparatus to fourth working apparatus," and the profile mother pipe is formed by hydraulic bulging in which an internal pressure load and axial pressing are combined.

Further, a fourth aspect of the invention is a hydraulic bulged product wherein "simple tapered pipe" is set in a die of the hydraulic bulging apparatus in any one of "first working apparatus to fourth working apparatus," the profile mother pipe described in (1) is produced, and the profile mother pipe is formed by hydraulic bulging in which an internal pressure load and axial pressing are combined.

BRIEF DESCRIPTION OF THE DRAWINGS

FIG. 1 is a view explaining conventional hydraulic bulging in which a straight pipe is used.

FIG. 3 is a view explaining a hydraulic bulging process with the conventional tapered mother pipe.

FIG. 5 is a view explaining a configuration of "first working apparatus" which is of a hydraulic bulging apparatus of the invention.

FIG. 6 is a view explaining another configuration of "first working apparatus" which is of the hydraulic bulging apparatus of the invention.

FIG. 8 is a view explaining a configuration of "second working apparatus" which is of a hydraulic bulging apparatus of the invention.

FIG. 9 is a view explaining another configuration of "second working apparatus" which is of the hydraulic bulging apparatus of the invention.

BEST MODE FOR CARRYING OUT THE INVENTION

FIG. 4 is a view showing a shape of a profile mother pipe for hydraulic bulging according to the invention. A profile mother pipe for hydraulic bulging TP2 of the invention is used for the hydraulic bulging. As shown in FIGS. 1A to 1F, the profile mother pipe for hydraulic bulging TP2 has a peripheral length in which an outer diameter is gradually increased or decreased from one end to the other end in an axial direction, and the profile mother pipe for hydraulic bulging TP2 has a configuration in which a holding portion is formed on at least one end side (first end side). In the holding portion, the peripheral length is increased toward the pipe end face.

Figure 1A:
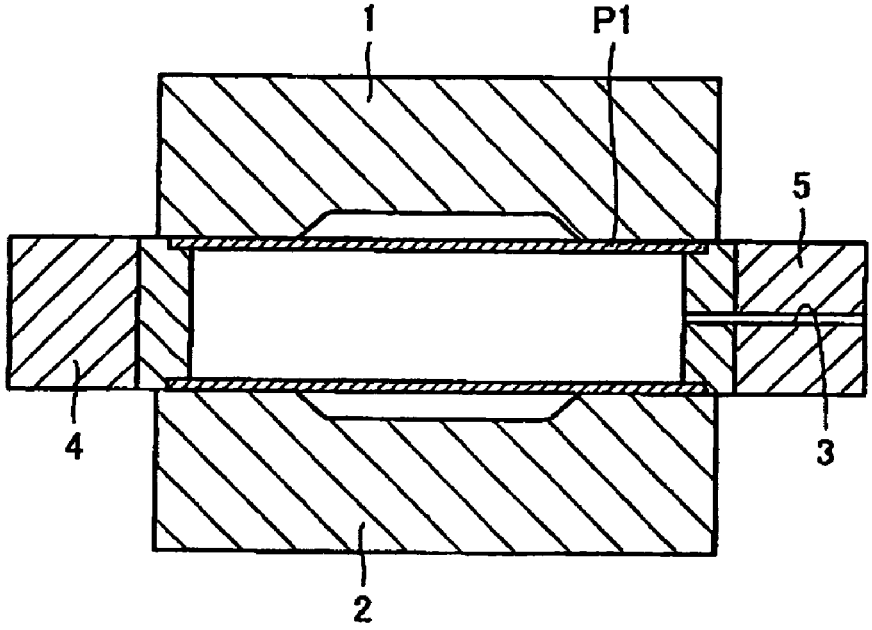
FIG. 1A shows a pre-hydraulic bulging sectional configuration.
Figure 1B:
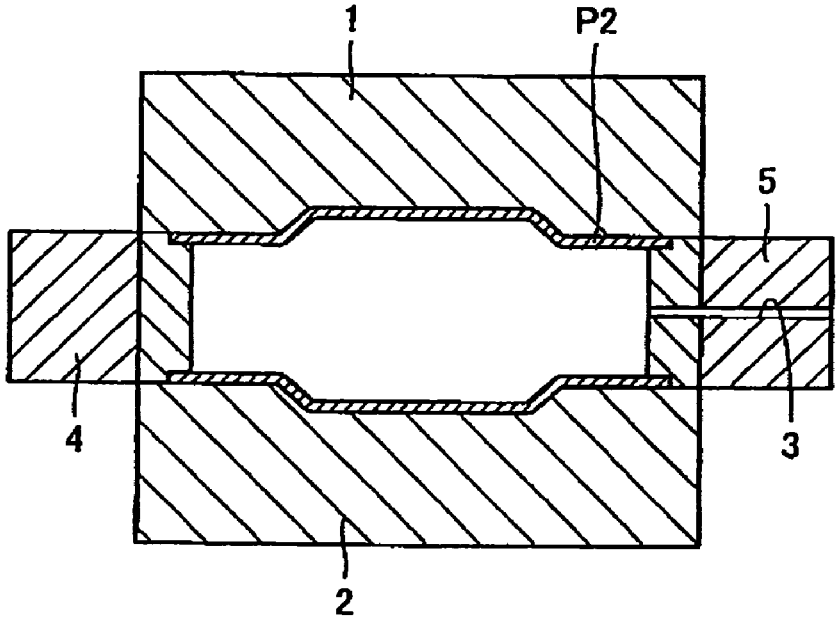
FIG. 1B shows a post-hydraulic bulging sectional configuration.
Figure 2:
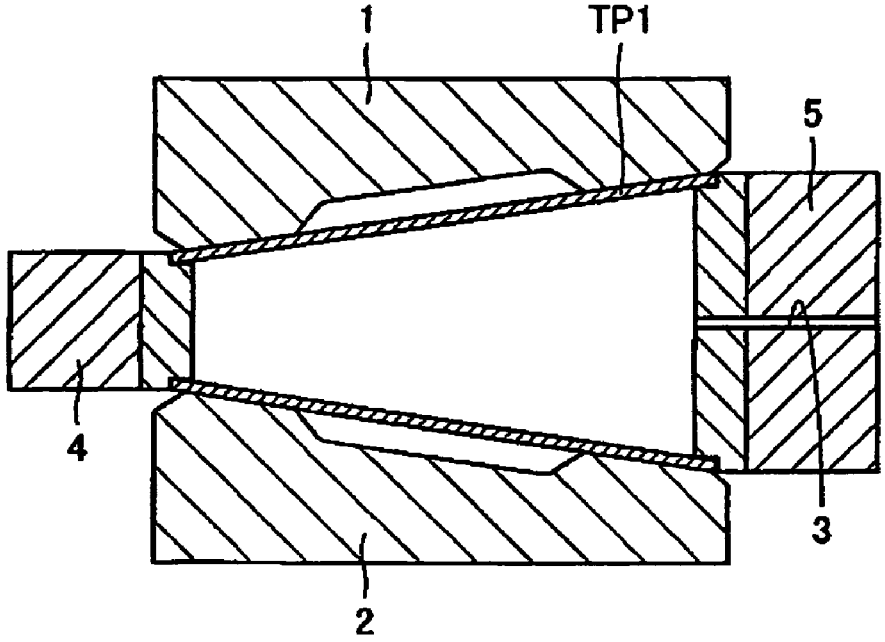
FIG. 2 is a view explaining a problem generated in the case where axial pressing is performed to a tapered mother pipe with a conventional straight mother pipe axial pressing tool.
Figure 3A:
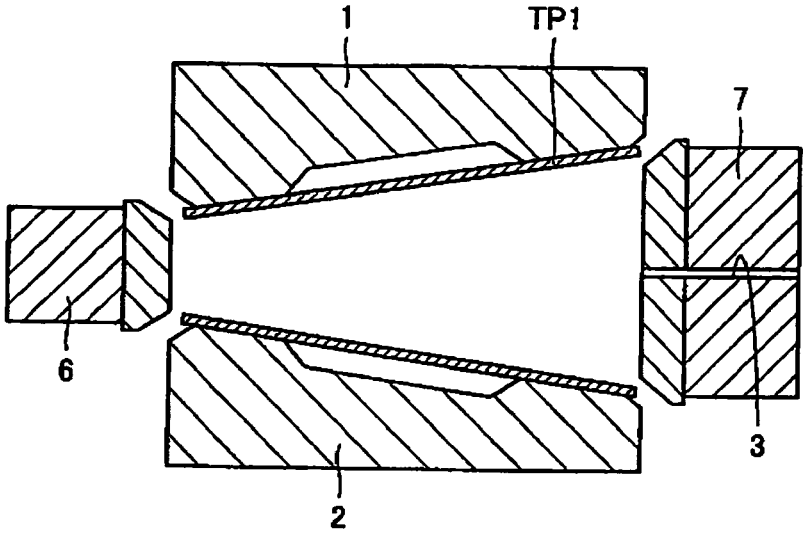
FIG. 3A shows a sectional configuration in which the tapered mother pipe which is of the starting material is set prior to the forming.
Figure 3B:
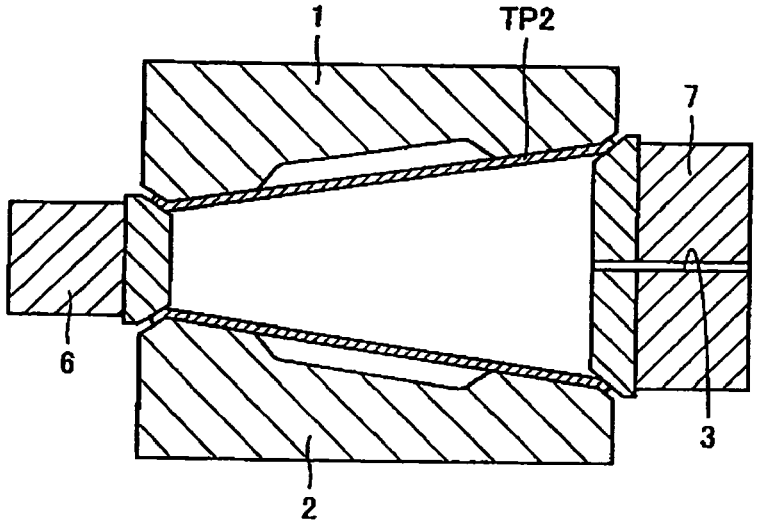
FIG. 3B shows a pre-hydraulic bulging sectional configuration in which a profile mother pipe for hydraulic bulging is formed.
Figure 3C:
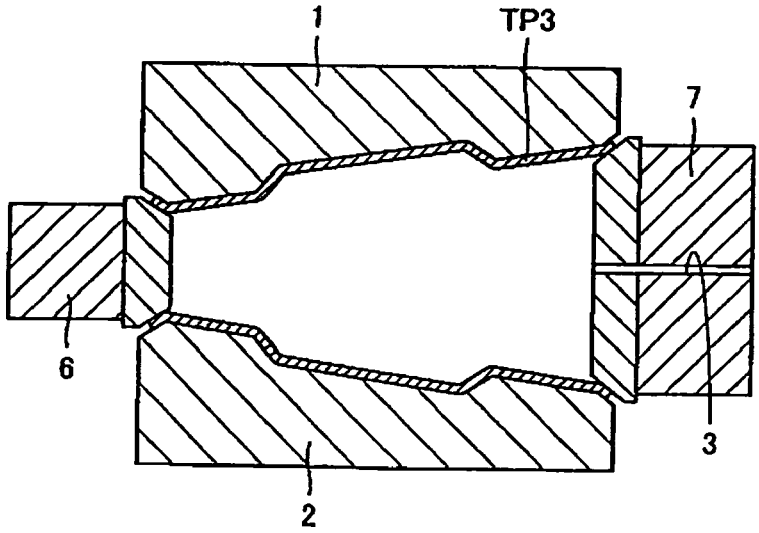
FIG. 3C shows a sectional configuration when the hydraulic bulging is ended.
Figure 4A:
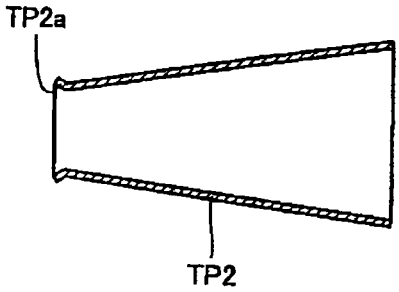
FIG. 4 is a view showing a shape of a profile mother pipe for hydraulic bulging according to the invention.
Figure 4B:
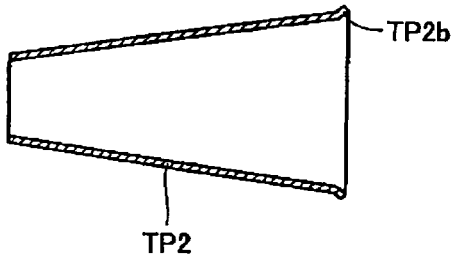
Figure 4C:
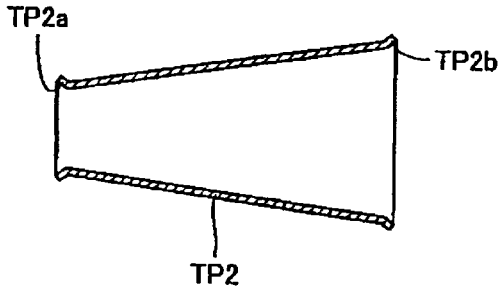

In shape examples shown in FIGS. 4A and 4B, a holding portion TP2*a* or TP2*b* is provided on a small-diameter end side or a large-diameter end side, and the holding portion is not provided on the other end side. In shape examples shown in FIGS. 4C and 4F, the holding portions TP2*a*, TP2*b* are provided on the small-diameter end side and the large-diameter end side respectively.

Figure 4D:
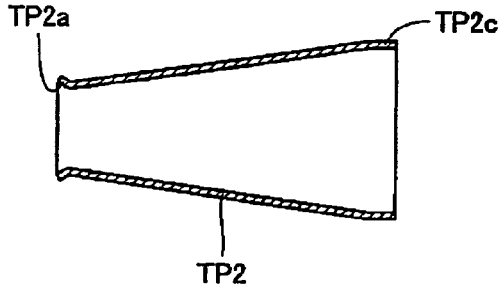
Figure 4E:
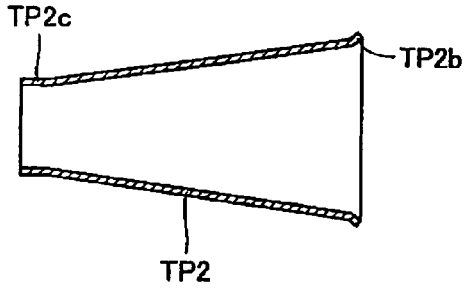

In shape examples shown in FIGS. 4D and 4E, the holding portion TP2*a* or TP2*b* is provided on one end side of the small-diameter end side and large-diameter end side, and a parallel portion TP2*c* is provided on the other end. The holding portions TP2*a*, TP2*b* provided in the profile mother pipe TP2 have a length necessary to secure the sealing characteristics during the bulging.

Figure 4F:
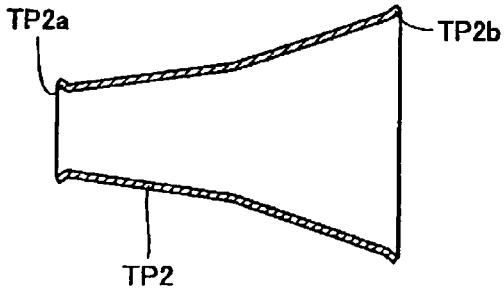

In the profile mother pipe for hydraulic bulging of the invention, it is stipulated that "the profile mother pipe has the peripheral length in which the outer diameter is gradually increased or decreased from one end to the other end in the axial direction." However, the profile mother pipe is not limited to the simple tapered pipe TP2 having the constant taper as shown in FIGS. 4A to 4E, but the profile mother pipe may be the tapered pipe TP2 in which the taper is varied in the axial direction as shown in FIG. 4F.

In the profile mother pipe for hydraulic bulging of the invention, it is not necessary to form the holding portion, in the case where the outer diameter is gradually increased and, at the same time, in the case where the sealing characteristics can be secured even if the holding portion is not formed on either end portion side, particularly on the large-diameter end side of the profile mother pipe.

From the standpoint that the sealing characteristics is secured, it is desirable that the holding portions be formed in both the end portions of the small-diameter end side and large-diameter end side. However, when the holding portion is formed on the large-diameter end side, in order to sufficiently secure the sealing characteristics, a rate of the increase in peripheral length of the holding portion should be larger than a rate of the increase in peripheral length of the mother pipe main portion.

In the profile mother pipe for hydraulic bulging of the invention, it is preferable that the parallel portion be formed in the end portion where the holding portion is not formed. In shape examples shown in FIGS. 4D and 4E, the parallel portion TP2*c* is formed on the large-diameter end side or on the small-diameter end side. Therefore, the axial pressing can be performed with a simple structure from the pipe end where the parallel portion TP2*c* is formed.

A hydraulic bulging apparatus according to the invention has an apparatus configuration, in which the hydraulic bulging is performed to the profile mother pipe for hydraulic bulging which is of the target of the hydraulic bulging. In the hydraulic bulging, the internal pressure load and the axial pressing are combined.

Therefore, the main apparatus configuration includes a pair of die main bodies and sealing tools. Front end portions of the sealing tools are inserted into the end portions of the pair of die main bodies in order to hold the end portions of the profile mother pipe while coupled with the pair of die main bodies. At least one of the sealing tools is configured to be movable, an injection hole of a working fluid is made in one of the sealing tools, and, during the bulging, an inner space formed by the die main bodies and the sealing tool can be varied as the movable sealing tool is moved.

The specific configuration of the hydraulic bulging apparatus of the invention is designed according to axial pressing conditions and the shape of the profile mother pipe for hydraulic bulging which is of the forming target.

That is, the apparatus configuration is adapted so as to be divided into "first working apparatus to third working apparatus" depending on the case where the axial pressing working is performed to the profile mother pipe in which the holding portion is formed on at least one end side(first end side), the case where the axial pressing working is performed to the profile mother pipe in which the holding portion is formed on the first end side while the parallel portion is formed on the other end side (second end side), and the case where the axial pressing working is performed to the profile mother pipe in which the holding portions are formed on both end sides.

In "first working apparatus to third working apparatus," the trust member is provided in order to effectively combine the internal pressure load and the axial pressing. The thrust member imparts the thrust force to the pipe end holding die after the working fluid is injected, and the thrust force faces the end portion of the die main body. This structure enables the sealing tool to be moved against the thrust force toward the axial direction of the profile mother pipe while the internal pressure is applied, and the hydraulic bulging in which the axial pressing working can be combined can be performed.

"Fourth working apparatus" is a hydraulic bulging apparatus having the configuration in which at least a set of a pair of intermediate holding dies and an thrust member imparting the thrust force to the pair of intermediate holding dies is sequentially arranged between the thrust member imparting the thrust force to the pair of pipe end holding dies and the pair of die main bodies.

That is, "fourth working apparatus" has a double slide structure of the die main body and the pipe end holding die (and the intermediate holding die), and the elastic member is placed between the die main body and the pipe end holding die (or between the pipe end holding die and the intermediate holding die and between the intermediate holding die and the die main body), which allows the axial pressing working to be performed from the pipe end toward the axial direction with a long stroke.

Further, an axial pressing speed can be controlled by adjusting an elastic coefficient of the elastic member. Even if the profile mother pipe having less workability is used, the expansion ratio larger than ever before can be secured, and the hydraulic bulged product having the more complicated shape can be obtained.

An axial pressing drive control device adopted in the hydraulic bulging apparatus of the invention may control axial pressing force of the sealing tool or control a sealing tool displacement (hereinafter referred to as "axial pressing displacement") when the axial pressing force is applied.

During the hydraulic bulging, the thrust force is imparted to the pipe end holding die by the elastic member (and the intermediate holding die and the elastic member), and the pipe end holding die abuts on the sealing tool with pressure not lower than pressing force which can maintain the sealing characteristics. Therefore, the leakage is not generated between the sealing tool and the profile mother pipe, and between the pipe end holding die and the profile mother pipe.

The profile mother pipe used for the hydraulic bulging may be a mother pipe in which the holding portion or the parallel portion is previously formed before the mother pipe is set in the hydraulic bulging apparatus of the invention or may be a mother pipe in which the holding portion or the parallel portion is formed shortly before the hydraulic bulging after the mother pipe is set in the hydraulic bulging apparatus of the invention.

In the case where the holding portion or the parallel portion is formed after the mother pipe is set in the hydraulic bulging apparatus of the invention, "simple tapered pipe" having the peripheral length in which the outer diameter is gradually increased or decreased from one end to the other end in the axial direction is used as the blank material of the profile mother pipe. "Simple tapered pipe" is set in the die of the hydraulic bulging apparatus, and the holding portion or the parallel portion is formed at a predetermined end portion as the sealing tool is moved.

In the description of the invention, "simple tapered pipe" shall mean the blank material of the profile mother pipe of the invention, i.e. the tapered pipe in which the holding portion or the parallel portion is not formed on one end side or on both end sides.

In the following, a hydraulic bulging apparatus of the invention, a hydraulic bulging method in which the hydraulic bulging apparatus is used, and a hydraulic bulged product will be described below with reference to the drawings.

Figure 5A:
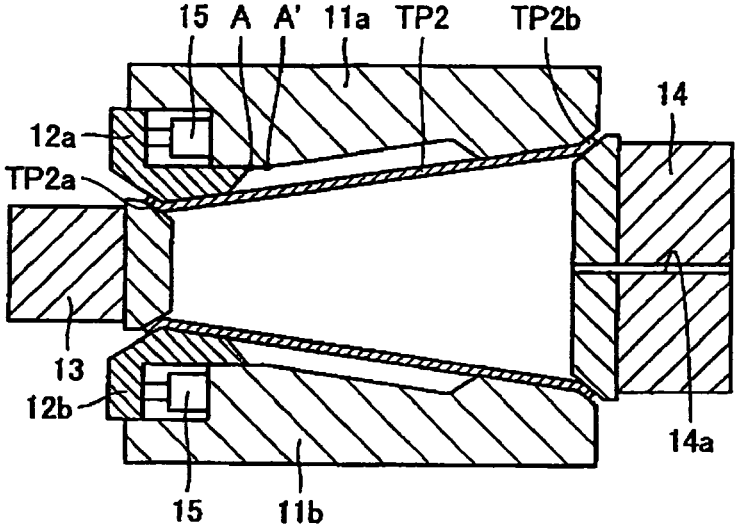
FIG. 5A shows a pre-hydraulic bulging sectional configuration in which the profile mother pipe is formed.
Figure 5B:
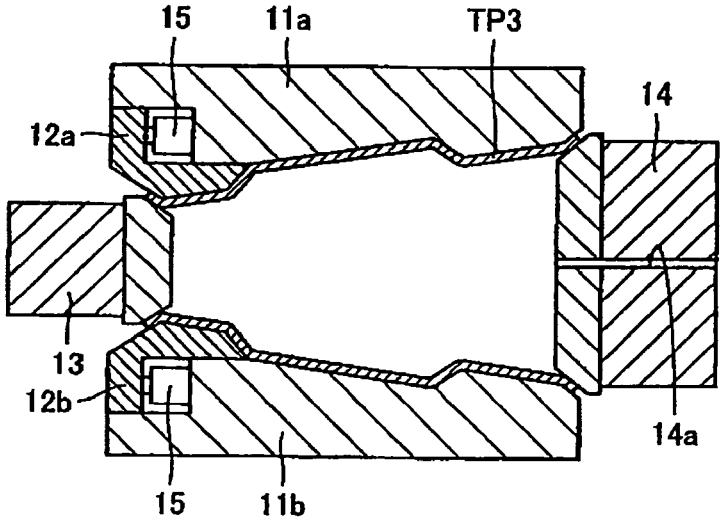
FIG. 5B shows a post-hydraulic bulging sectional configuration.
Figure 5C:
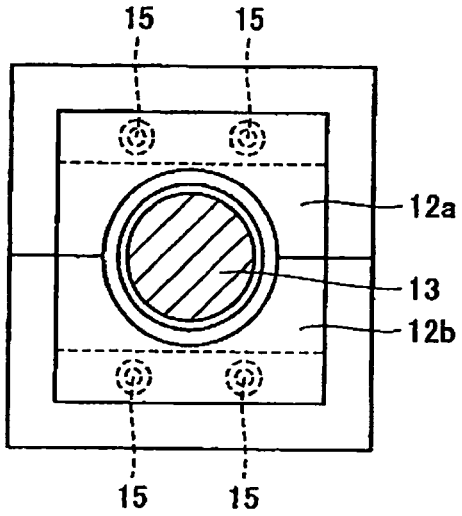
FIG. 5C shows a pre-hydraulic bulging configuration on a small-diameter end side.

FIG. 5 is a view explaining a configuration of "first working apparatus" which is of the hydraulic bulging apparatus of the invention, FIG. 5A shows a pre-hydraulic bulging sectional configuration in which the profile mother pipe is formed, FIG. 5B shows a post-hydraulic bulging sectional configuration, and FIG. 5C shows a pre-hydraulic bulging configuration on a small-diameter end side (side view on left-hand side).

"First working apparatus" is a hydraulic bulging apparatus which performs the axial pressing working from one end side using the profile mother pipe TP2 in which the holding portion is formed on one end side. A pair of die main bodies 11 and a pair of pipe end holding dies 12 are arranged in "first working apparatus." The pair of die main bodies 11 forms a cavity and the pair of pipe end holding dies 12 is arranged on the other end side of the die main body 11. The die main body 11 includes upper and lower die main bodies 11*a*, 11*b*, and the pipe end holding die 12 includes upper and lower pipe end holding dies 12*a*, 12*b*.

In the profile mother pipe TP2 shown in FIG. 5, holding portions TP2*a* and TP2*b* are provided on the small-diameter end side and large-diameter end side respectively. The hydraulic bulging apparatus has the configuration shown in FIG. 5, in which the axial pressing working is performed from the small-diameter end side and a sealing tool 13 provided on the small-diameter end side is adapted to be movable.

Therefore, the sealing tool 13 provided on the small-diameter end side is configured such that the front-end portion of the sealing tool 13 is inserted between the upper and lower pipe end holding dies 12*a*, 12*b*. The holding portion TP2*a* on the small-diameter end side of the profile mother pipe TP2 is sandwiched and held to secure the sealing characteristic by the sealing tool 13 and the upper and lower pipe end holding dies 12*a*, 12*b*.

On the other hand, a sealing tool 14 provided on the large-diameter end side is configured such that the front-end portion of the sealing tool 14 is inserted between the upper and lower die main bodies 11*a*, 11*b*. The holding portion TP2*b* on the large-diameter end side of the profile mother pipe TP2 is sandwiched and held to secure the sealing characteristics by the sealing tool 14 and the upper and lower pipe end holding dies 11*a*, 11*b*. An injection hole 14*a* for the working fluid is made at an axial center position of the sealing tool 14.

Elastic members 15 imparting the thrust force to the pipe end holding die 12 are arranged between the upper and lower die main bodies 11*a*, 11*b* and the upper and lower pipe end holding dies 12*a*, 12*b* respectively. For example, a gas cushion or a hydraulic cylinder is used as the elastic members 15. The thrust members 15 impart the thrust forces facing the end portions of the die main bodies 11*a*, 11*b* to the upper and lower pipe end holding dies 12*a*, 12*b* at least after the working fluid is injected.

As shown in FIG. 5C, the pair of thrust members 15 are arranged in each of the upper and lower pipe end holding dies 12*a*, 12*b*. The pipe end holding dies 12*a*, 12*b* abut on the sealing tool 13 with the thrust force not lower than the pressing force which can maintain the seal-tightness by the action of the thrust force imparted by the elastic members 15, which allow the sealing characteristics to be secured during the bulging forming.

In the case where the forming is performed with "first working apparatus," while the front ends of the upper and lower pipe end holding dies 12*a*, 12*b* are located at a point A of FIG. 5A before the hydraulic bulging, the front ends of the upper and lower pipe end holding dies 12*a*, 12*b* are located at point A' of FIG. 5A after the hydraulic bulging.

Therefore, the pre-hydraulic bulging is larger than the post-hydraulic bulging by a distance A-A' in the axial direction, in an inner space formed by the upper and lower die main bodies 11*a*, 11*b*, the upper and lower pipe end holding dies 12*a*, 12*b*, the sealing tool 13, and the sealing tool 14.

The holding portion of the profile mother pipe TP2 may be formed with "first working apparatus." In this case, it is necessary that the bulging profile mother pipe TP2 be produced as pre-treatment of the hydraulic bulging by the apparatus configuration shown in FIG. 5.

In the case where the bulging profile mother pipe TP2 is produced with "first working apparatus," "simple tapered pipe" which is of the blank material of the profile mother pipe TP2 is set in the upper and lower die main bodies 11*a*, 11*b* and the upper and lower pipe end holding dies 12*a*, 12*b*. Then, the holding portion is formed by crushing one end portion or both end portions of "simple tapered pipe" while the axial pressing displacement or the axial pressing force is controlled. In the profile mother pipe TP2 shown in FIG. 5, the holding portions TP2*a*, TP2*b* are formed on the both end portions.

Then, the sealing tool 14 provided on the large-diameter end side and the sealing tool 13 provided on the pipe end holding die side (namely, the small-diameter end side) abut on the upper and lower die main bodies 11*a*, 11*b* and the upper and lower pipe end holding dies 12*a*, 12*b* respectively, and the working fluid is injected into the profile mother pipe TP2 through the injection hole 14*a* while the sealing characteristics is maintained.

During the hydraulic bulging, the sealing tool 13 whose front end portion is inserted into the pipe end holding die 12 is moved in the axial direction while the internal pressure is applied to the profile mother pipe TP2, and the pipe end holding die 12 is moved against the thrust force imparted from the thrust member 15.

Therefore, the front ends of the upper and lower pipe end holding dies 12*a*, 12*b* are moved from the point A before the working to the point A' after the working as shown in FIG. 5A, and the inner space formed by the die main bodies 11*a*, 11*b*, the pipe end holding dies 12*a*, 12*b*, and the sealing tools 13 and 14 is varied until the inner space coincides with the shape of a hydraulic bulged product PT3 shown in FIG. 5B.

In "first working apparatus," the sealing characteristics is secured by the action of the thrust members 15 after the working fluid is injected, so that the working fluid never leaks between the upper and lower die main bodies 11*a*, 11*b* and the profile mother pipe TP2 or between the upper and lower pipe end holding dies 12*a*, 12*b* and the profile mother pipe TP2.

Figure 6A:
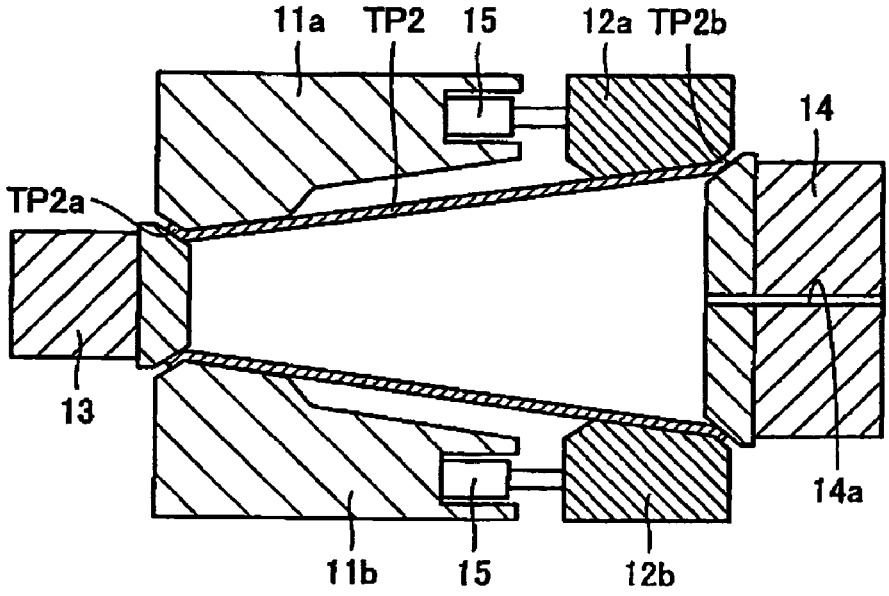
FIG. 6A shows a pre-hydraulic bulging sectional configuration in which the profile mother pipe is formed.
Figure 6B:
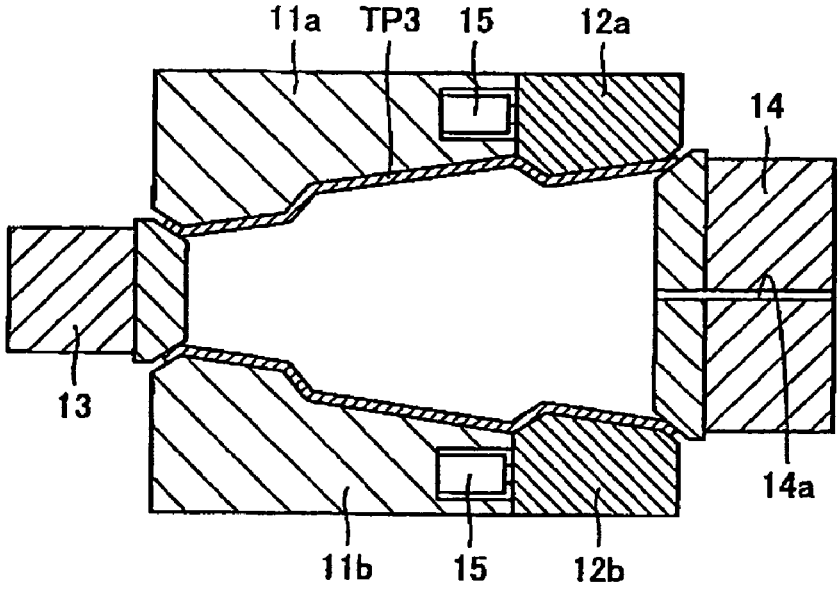
FIG. 6B shows a post-hydraulic bulging sectional configuration.

FIG. 6 is a view explaining another configuration of "first working apparatus" which is of the hydraulic bulging apparatus of the invention, FIG. 6A shows a pre-hydraulic bulging sectional configuration in which the profile mother pipe is formed, and FIG. 6B shows a post-hydraulic bulging sectional configuration. "First working apparatus" shown in FIG. 6 is a hydraulic bulging apparatus in which the axial pressing working is performed from the large-diameter end side. In "first working apparatus," the sealing tool 14 provided on the large-diameter end side can be moved, and the upper and lower pipe end holding dies 12*a*, 12*b* are arranged on the large-diameter end side. Unlike the configuration shown in FIG. 5, the pipe end holding die 12 shown in FIG. 6 is not accommodated and set inside the end portion of the die main body 11, but the pipe end holding die 12 is set on an end face of and abreast of the die main body 11. However, "first working apparatus" shown in FIG. 6 produces the same action and effect in the hydraulic bulging.

Figure 7:
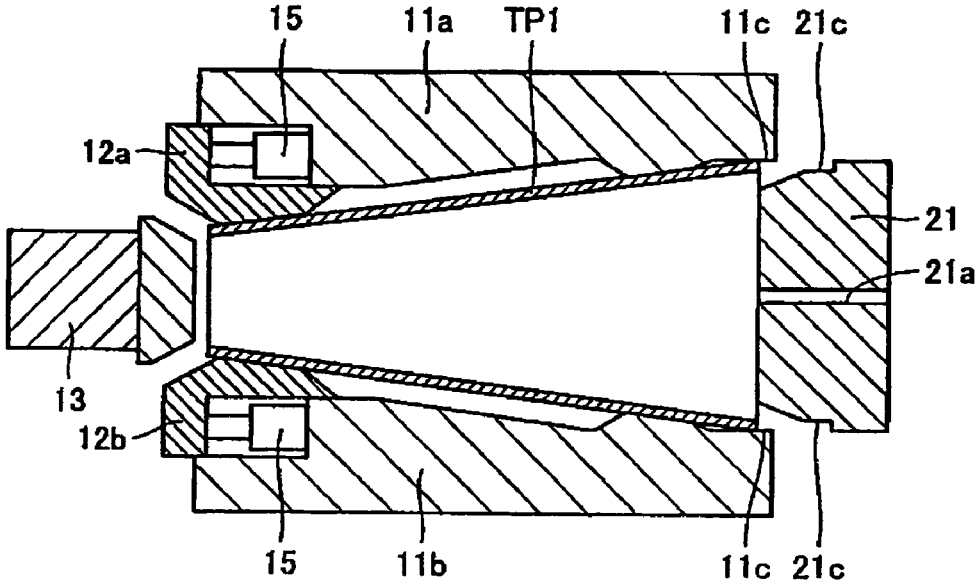
FIG. 7 is a view showing a sectional configuration of a state in which "simple tapered pipe" which is of a starting material is set in a die main body.
Figure 8A:
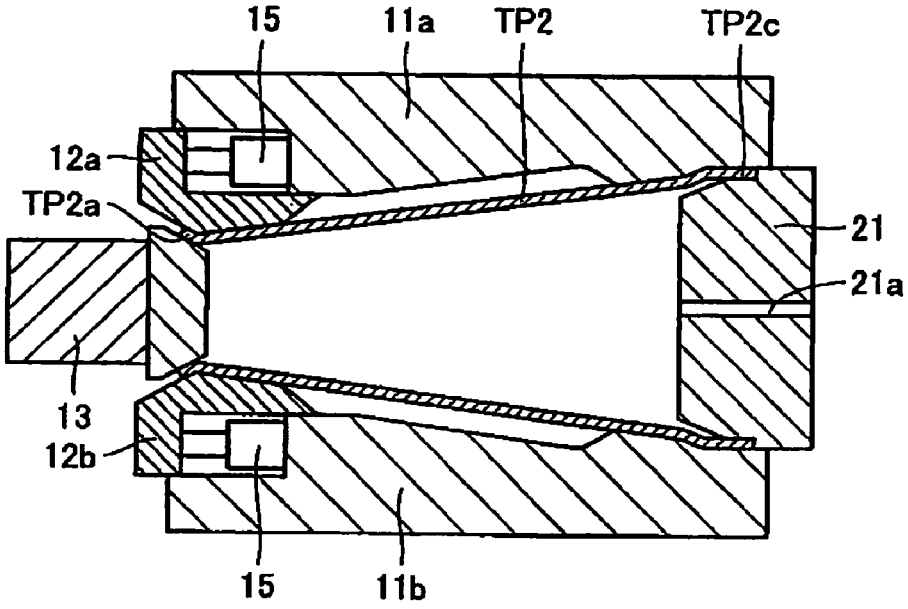
FIG. 8A shows a pre-hydraulic bulging sectional configuration in which an profile mother pipe having a holding portion and a parallel portion is formed.
Figure 8B:
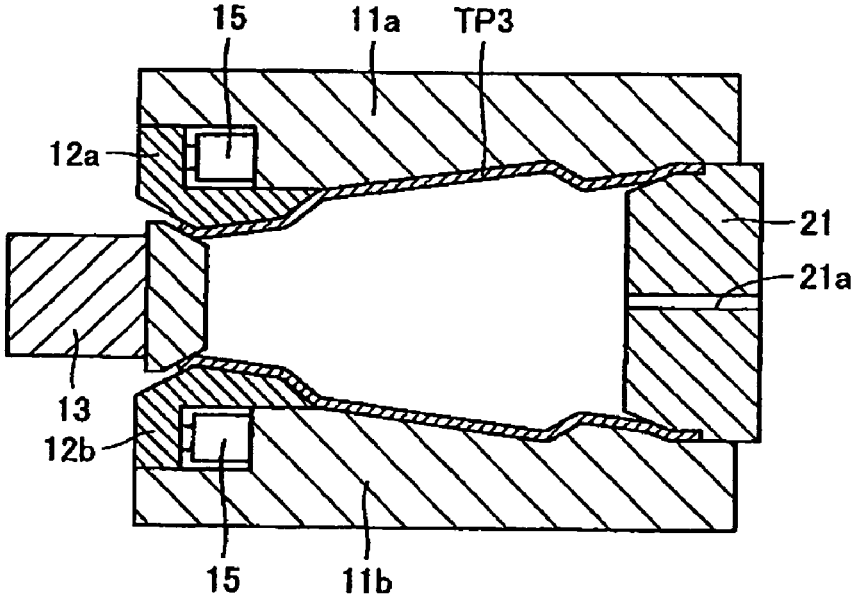
FIG. 8B shows a post-hydraulic bulging sectional configuration.

FIGS. 7 and 8 are a view showing a configuration of "second working apparatus" which is of the hydraulic bulging apparatus of the invention. FIG. 8A shows a pre-hydraulic bulging sectional configuration in which the profile mother pipe having a holding portion and a parallel portion is formed, and FIG. 8B shows a post-hydraulic bulging sectional configuration.

"Second working apparatus" is a hydraulic bulging apparatus for performing the axial pressing working from the both end sides using the profile mother pipe in which the holding portion is formed on one end side while the parallel portion is formed on the other end side. In the apparatus configuration shown in FIG. 8, holding portion T2*a* is provided on the small-diameter end side and the parallel portion TP2*c* is provided in the large-diameter end side.

Therefore, in the configuration of "first working apparatus" shown in FIG. 5, on the large-diameter end side of the pair of die main bodies 11, parallel portions 11*c*, 21*c* are provided in inner surfaces of the end portions of the die main bodies 11*a*, 11*b* and an outer surface of a sealing tool 21 corresponding to the inner surfaces of the end portions respectively. The inner surfaces of the end portions are adjacent to the parallel portion TP2*c* of the profile mother pipe TP2.

In the specific configuration of "second working apparatus," the sealing tool 13 provided in the small-diameter end side is configured such that the front-end portion of the sealing tool 13 is inserted between the upper and lower pipe end holding dies 12*a*, 12*b*. The holding portion TP2*a* on the small-diameter end side of the profile mother pipe TP2 is sandwiched to secure the tight sealing by the sealing tool 13 and the upper and lower pipe end holding dies 12*a*, 12*b*.

On the other hand, the sealing tool 21 provided on the large-diameter end side is configured such that the front-end portion of the sealing tool 21 is inserted between the end portions on the large-diameter end sides of the upper and lower die main bodies 11*a*, 11*b*. The parallel portions 11*c*, 21*c* are provided in the inner surfaces of the end portions of the die main bodies 11*a*, 11*b* and the outer surface of the sealing tool 21 corresponding to the inner surfaces of the end portions such that the parallel portion TP2*c* on the large-diameter end side of the profile mother pipe TP2 is sandwiched to secure the tight sealing by the sealing tool 21 and the upper and lower die main bodies 11*a*, 11*b*.

During the axial pressing, the parallel portion 21*c* in the outer surface of the sealing tool 21 exerts the action in which the mother pipe is constrained from the inner surface to enable the mother pipe to be smoothly deformed. An injection hole 21*a* for the working fluid is provided in the axial center position of the sealing tool 21.

As described above, the profile mother pipe TP2 may be produced with "first working apparatus." Similarly the profile mother pipe TP2 may be produced with "second working apparatus."

FIG. 7 is a view showing a sectional configuration of a state in which "simple tapered pipe" which is of the starting material is set in the die main body. In the case where the profile mother pipe is produced, as shown in FIG. 7, "simple tapered pipe TP1" which is of the raw material of the profile mother pipe TP2 of the invention is set in the upper and lower die main bodies 11*a*, 11*b* and the upper and lower pipe end holding dies 12*a*, 12*b* of the hydraulic bulging apparatus which is of "second working apparatus."

Then, the sealing tool 13 and the sealing tool 21 are moved in the axial direction, and the holding portion TP2*a* is formed in the end portion on the small-diameter end side of "simple tapered pipe TP1" which is sandwiched and held between the upper and lower pipe end holding dies 12*a*, 12*b* and the sealing tool 13, and the parallel portion TP2*c* is formed in the end portion on the large-diameter end side of "simple tapered pipe TP1" which is sandwiched and held between the upper and lower die main bodies 11*a*, 11*b* and the sealing tool 21. The profile mother pipe TP2 used for the hydraulic bulging is formed by this pre-treatment.

After the profile mother pipe for hydraulic bulging TP2 is formed, as shown in FIG. 8A, similarly to the original case where the profile mother pipe TP2 is adopted to "second working apparatus," the sealing tools 13 and 21 are further moved in the axial direction to perform the hydraulic bulging while the internal pressure of the working fluid is increased. Finally, as shown in FIG. 8B, the hydraulic bulged product TP3 can be obtained.

Thus, in the case where the hydraulic bulging is performed with "second working apparatus," the axial pressing can be performed with the simple structure even in the end portion in which the parallel portion is formed. As a result, the expansion ratio larger than ever before can be obtained in the hydraulic bulged product TP3.

Even if the axial pressing working is not performed from the end portion side on which the parallel portion is formed, the sealing characteristics can be improved during the hydraulic bulging by forming the parallel portion in the end portion of the profile mother pipe. Similarly, even if the axial pressing working is not performed from the end portion side on which the holding portion is formed, the sealing characteristics can be improved during the hydraulic bulging.

Figure 9A:
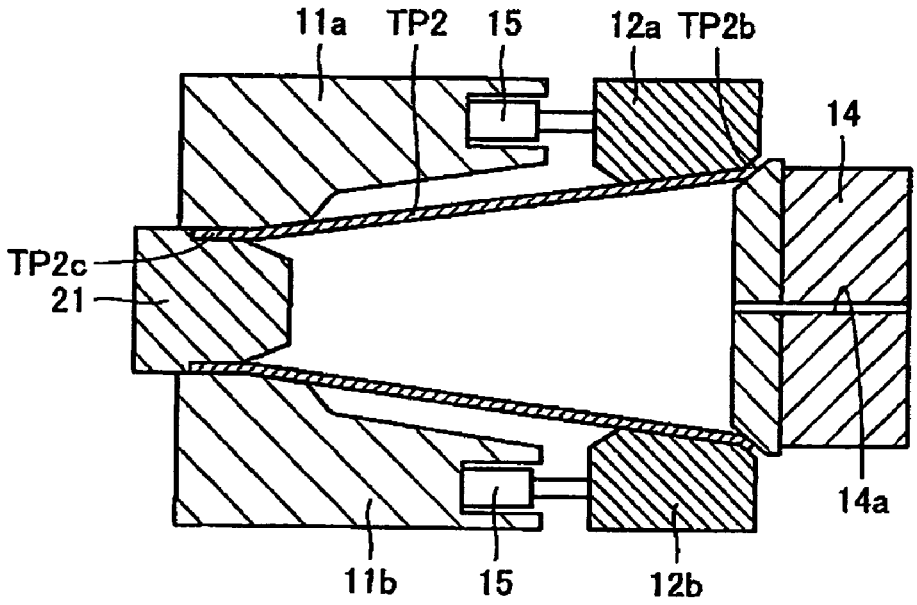
FIG. 9A shows a pre-hydraulic bulging sectional configuration in which the profile mother pipe is formed.
Figure 9B:
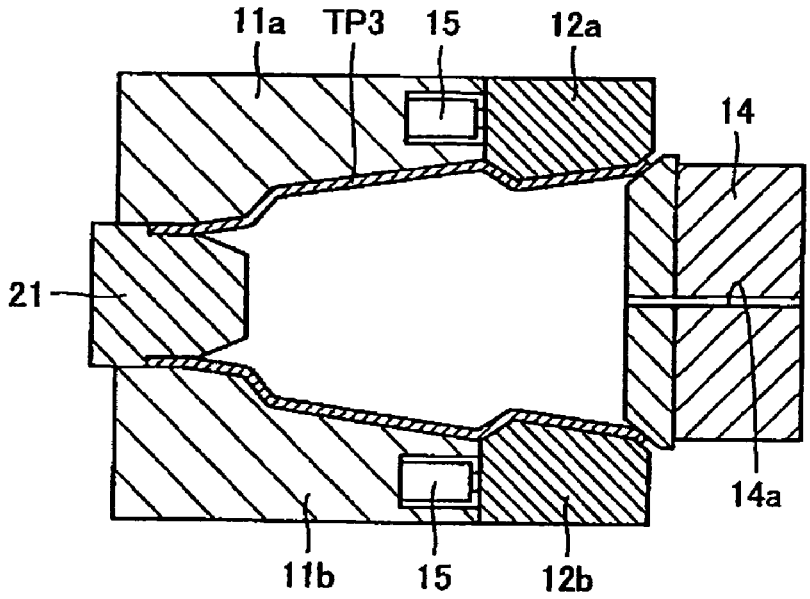
FIG. 9B shows a post-hydraulic bulging sectional configuration.

FIG. 9 is a view explaining another configuration of "second working apparatus" which is of the hydraulic bulging apparatus of the invention, FIG. 9A shows a pre-hydraulic bulging sectional configuration in which the profile mother pipe is formed, and FIG. 9B shows a post-hydraulic bulging sectional configuration.

In "second working apparatus" shown in FIG. 9, the holding portion TP2*b* is provided on the large-diameter end side, and the parallel portion TP2*c*is provided on the small-diameter end side. The sealing tool 14 provided on the large-diameter end side is movable, and the upper and lower pipe end holding dies 12*a*, 12*b* are arranged on the large-diameter end side.

In "second working apparatus" shown in FIG. 9, the parallel portion TP2*c* is provided on the small-diameter end side to perform the axial pressing. Therefore, when compared with the case where parallel portion TP2*c* is provided on the large-diameter end side to perform the axial pressing, the sealing tool 21 can smoothly be moved to stably perform the axial pressing.

In the configuration shown in FIG. 9, the pipe end holding die 12 is not accommodated and set inside the end portion of the die main body 11, but the pipe end holding die 12 is set on the end face of and abreast of the die main body 11. However, the pipe end holding die 12 produces the same action and effect in the hydraulic bulging.

Figure 10:
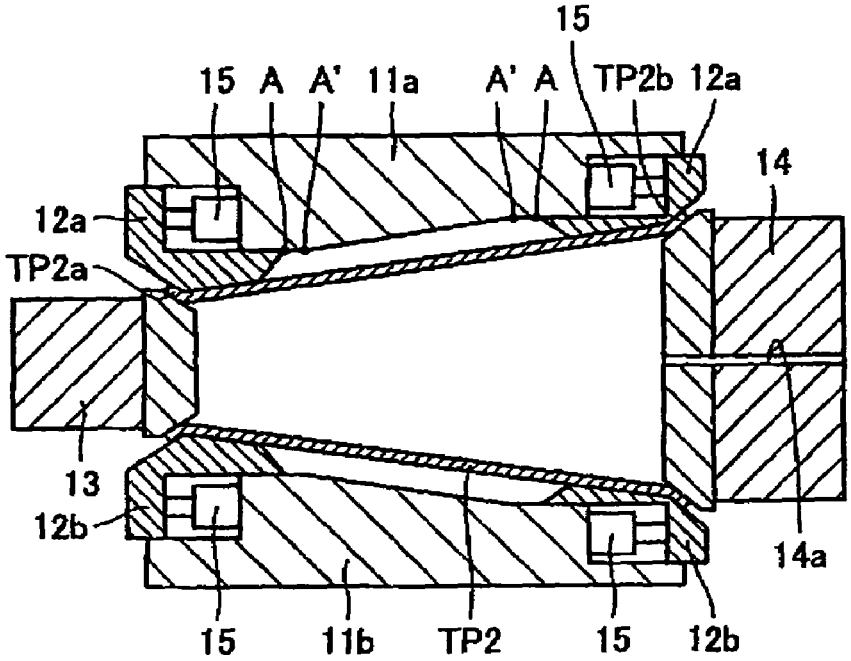
FIG. 10 is a view explaining a configuration of "third working apparatus" which is of a hydraulic bulging apparatus according to the invention.

FIG. 10 is a view explaining a configuration of "third working apparatus" which is of the hydraulic bulging apparatus according to the invention. In the apparatus configuration shown in FIG. 10, the upper and lower pipe end holding dies 12*a*, 12*b* are arranged in the end portions on the both sides of the upper and lower die main bodies 11*a*, 11*b* respectively.

"Third working apparatus" is a hydraulic bulging apparatus in which the axial pressing working is performed from the both end sides using the profile mother pipe in which the holding portions are formed on the both end sides. Therefore, the upper and lower pipe end holding dies 12*a*, 12*b* are arranged in the both end portions of the pair of die main bodies 11*a*, 11*b*, and the sealing tools 13 and 14 whose front end portions are inserted into the pipe end holding dies 12*a*, 12*b* are provided in order to hold the holding portions TP2*a*, TP2*b* of the both end portions of the profile mother pipe between the pipe end holding dies 12*a*, 12*b* and the sealing tools 13 and 14.

The hydraulic bulging is performed with "third working apparatus" is similar to the hydraulic bulging is performed with "first working apparatus" except that the axial pressing working is performed from the both side of the die main body 11.

Figure 11:
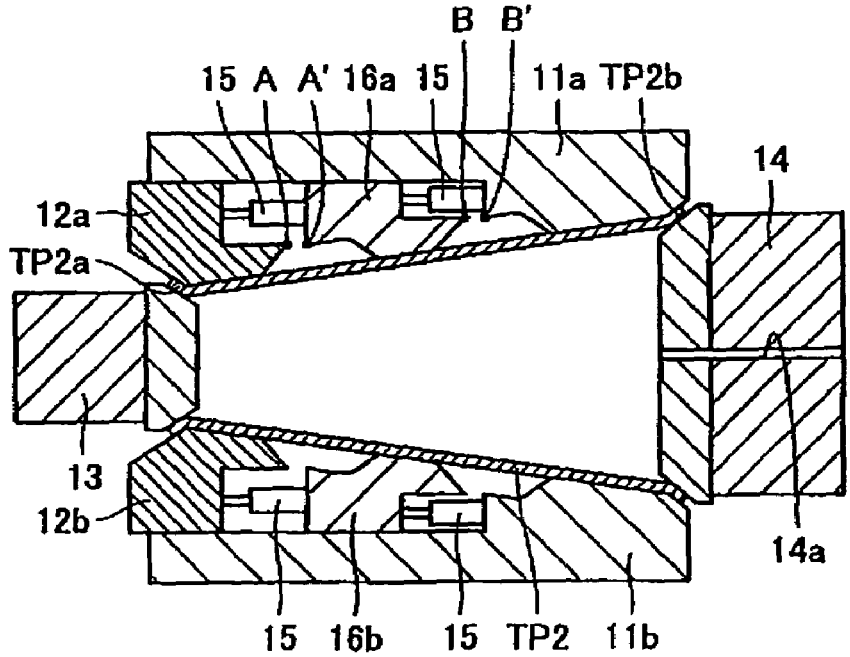
FIG. 11 is a view explaining a configuration of "fourth working apparatus" which is of a hydraulic bulging apparatus according to the invention.

FIG. 11 is a view explaining a configuration of "fourth working apparatus" which is of the hydraulic bulging apparatus according to the invention. "Fourth working apparatus" has the apparatus configuration corresponding to the embodiments of "first working apparatus and second working apparatus."

"Fourth working apparatus" shown in FIG. 11 has the configuration in which the thrust members 15 imparting the thrust force to the upper and lower pipe end holding dies 12*a*, 12*b* in "first working apparatus" shown in FIG. 5, a set of upper and lower intermediate holding dies 16*a*, 16*b* located between the thrust members 15—imparting the thrust force to the upper and lower intermediate holding dies 16*a*, 16*b*—and the upper and lower die main bodies 11*a*, 11, and said thrust members 15—imparting the thrust force to the upper and lower intermediate holding dies 16*a*, 16*b*—are sequentially arranged.

In the case where the hydraulic bulging is performed with "fourth working apparatus," before the hydraulic bulging, the front ends of the upper and lower pipe end holding dies 12*a*, 12*b* are located at the point A shown in FIG. 11, and the front ends of the upper and lower intermediate holding dies 16*a*, 16*b* are located at the point B shown in FIG. 11.

After the hydraulic bulging, the front ends of the upper and lower pipe end holding dies 12*a*, 12*b* are located at the point A' shown in FIG. 11, and the front ends of the upper and lower intermediate holding dies 16*a*, 16*b* are located at the point B' shown in FIG. 11.

Therefore, the pre-hydraulic bulging is larger than the post-hydraulic bulging by the distances of A-A' and B-B' in the axial direction in the inner space formed by the upper and lower die main bodies 11*a*, 11*b*, the pipe end holding dies 12*a*, 12*b*, the intermediate holding dies 16*a*, 16*b*, the pipe end holding 1 die-side sealing tool 13, and the die main body-side sealing tool 14.

In the case where the hydraulic bulging is performed with "fourth working apparatus," the previously produced profile mother pipe TP2 may be adopted, or the hydraulic bulging may be performed after the profile mother pipe TP2 is produced with "fourth working apparatus."

In order to produce the profile mother pipe TP2 used for the hydraulic bulging with "fourth working apparatus," "simple tapered pipe" which becomes the blank material of the profile mother pipe TP2 is set in the upper and lower die main bodies 11*a*, 11*b*, the pipe end holding dies 12*a*, 12*b*, and the intermediate holding dies 16*a*, 16*b*.

Then, while the axial pressing displacement or the axial pressing force is controlled, the crushing working is performed to the both end portions of "simple tapered pipe" with the sealing tools 13 and 14 to obtain the profile mother pipe TP2 in which the holding portions TP2*a* and TP2*b* are formed on the both ends. After the holding portions TP2*a* and TP2*b* of the profile mother pipe TP2 are sealed, the working fluid is injected into the profile mother pipe TP2 through the injection hole 14*a*.

During the hydraulic bulging, the sealing tool 13 is moved in the axial direction while the internal pressure is applied to the profile mother pipe TP2, which allows the upper and lower pipe end holding dies 12*a*, 12*b* and the upper and lower intermediate holding dies 16*a*, 16*b* to be moved against the thrust force.

In association with the movements of the upper and lower pipe end holding dies 12*a*, 12*b* and upper and lower intermediate holding dies 16*a*, 16*b*, the front ends of the upper and lower pipe end holding dies 12*a*, 12*b* and upper and lower intermediate holding dies 16*a*, 16*b* are moved to the points A' and B' shown in FIG. 11 where the inner space coincides with the shape of the hydraulic bulged product PT3, and the internal pressure and the axial pressing working are applied to the profile mother pipe TP2.

The apparatus configurations shown in FIGS. 5 to 11 are the specific modes of the hydraulic bulging apparatus of the invention by way of example. The hydraulic bulging apparatus of the invention is not limited to the apparatus configurations shown in FIGS. 5 to 11. The relatively simple shape is adopted as the shape of the die main body in the apparatus configurations shown in FIGS. 5 to 11. Obviously the die main body of the invention can be applied to a three-dimensional complicated shape typified by usual automobile components.

In the above embodiment, "simple tapered pipe" is used as the blank material of the profile mother pipe TP2. However, the invention is not limited to "simple tapered pipe." For example, a tapered pipe which is curved by performing bending or pre-forming, or a tapered pipe which formed in a flat shape by crushing can also be used as the blank material of the profile mother pipe TP2.

In the apparatus configuration shown in FIG. 11, the upper and lower intermediate holding dies 16*a*, 16*b* are in contact with the profile mother pipe TP2. However, it is not always necessary that the upper and lower intermediate holding dies 16*a*, 16*b* be in contact with the profile mother pipe TP2, and the upper and lower intermediate holding dies 16*a*, 16*b* may have an arbitrary template contour.

In the apparatus configuration shown in FIGS. 5 to 11, the front-end shapes of the sealing tools 13, 14, and 21 are represented by the simple truncated cone. However, the front-end shapes of the sealing tools 13, 14, and 21 are not necessarily limited to the simple truncated cone. For example, a shape having a step on the slant surface of the truncated cone or a shape in which an inner surface seal or an end face seal is performed with an O-ring may be used as the front-end shapes of the sealing tools 13, 14, and 21.

INDUSTRIAL APPLICABILITY

The profile mother pipe for hydraulic bulging of the invention has the peripheral length in which the outer diameter is gradually increased or decreased from one end to the other end in the axial direction. Further, in the profile mother pipe for hydraulic bulging of the invention, the holding portion where the peripheral length is increased toward the pipe end face on one end side can be formed on at least one end side, and the parallel portion can be formed on the end side where the holding portion is not formed. In the working apparatus and working method in which the profile mother pipe is used, the pressing working can be performed from the pipe end toward the axial direction even in the use of the profile mother pipe in which the sectional shape is largely changed in the axial direction. Accordingly, in the hydraulic bulged product to which the hydraulic bulging is performed, the expansion ratio larger than ever before can be obtained, and the invention can be applied to the automotive industry and the wide fields of the industrial machinery.

What is claimed is:

1. A profile mother pipe for hydraulic bulging, wherein the profile mother pipe for hydraulic bulging has a peripheral length whose outer diameter is gradually increased or decreased from one end to the other end in an axial direction such that the profile mother pipe has a first end side of larger diameter than a second side end; the profile mother pipe comprising a main portion and a holding portion, the holding portion formed on at least one of the first and second end sides, said peripheral length in said holding portion being increased toward a pipe end face on one or both of the first and second end sides that includes the holding portion; wherein a rate of increase in peripheral length of said holding portion is larger than a rate of increase in peripheral length of the main portion of said profile mother pipe.

2. The profile mother pipe for hydraulic bulging according to claim 1, wherein the holding portion is formed on one of the first and second end sides and a parallel portion is formed on the other of the first and second sides, the parallel portion comprising a segment of the profile mother pipe parallel to a longitudinal axis thereof.

3. A hydraulic bulging method, wherein the profile mother pipe according to claim 2 is set in a die of a hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe along with said pipe end holding die;

a second sealing tool in which a parallel portion is provided in an inner surface of the end portion on the second end side in said die main body, the inner surface of the end portion corresponding to a parallel portion of said profile mother pipe, a parallel portion being provided in an outer surface corresponding to the parallel portion of said profile mother pipe to insert a front-end portion of the second sealing tool into said die main body in order to hold an end portion on the second end side of said profile mother pipe along with the parallel portion of said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, at least the first sealing tool holding the end portion on the first end side of said profile mother pipe is moved in the axial direction, and said pipe end holding die is moved against the thrust force of said thrust member as the first sealing tool holding the end portion on the first end side of said profile mother pipe is moved in the axial direction; and hydraulic bulging in which an internal pressure load and axial pressing are combined is performed to said profile mother pipe.

4. A hydraulic bulging method, wherein the profile mother pipe according to claim 2 is produced using a hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe along with said pipe end holding die;

a second sealing tool in which a parallel portion is provided in an inner surface of the end portion on the second end side in said die main body, the inner surface of the end portion corresponding to a parallel portion of said profile mother pipe, a parallel portion being provided in an outer surface corresponding to the parallel portion of said profile mother pipe to insert a front-end portion of the second sealing tool into said die main body in order to hold an end portion on the second end side of said profile mother pipe along with the parallel portion of said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, at least the first sealing tool holding the end portion on the first end side of said profile mother pipe is moved in the axial direction, and said pipe end holding die is moved against the thrust force of said thrust member as the first sealing tool holding the end portion on the first end side of said profile mother pipe is moved in the axial direction; and hydraulic bulging in which an internal pressure load and axial pressing are combined is performed to said profile mother pipe.

5. A hydraulic bulged and axially press worked product, wherein the profile mother pipe according to claim 2 is set in a die of the hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe along with said pipe end holding die;

a second sealing tool in which a parallel portion is provided in an inner surface of the end portion on the second end side in said die main body, the inner surface of the end portion corresponding to a parallel portion of said profile mother pipe, a parallel portion being provided in an outer surface corresponding to the parallel portion of said profile mother pipe to insert a front-end portion of the second sealing tool into said die main body in order to hold an end portion on the second end side of said profile mother pipe along with the parallel portion of said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, at least the first sealing tool holding the end portion on the first end side of said profile mother pipe is moved in the axial direction, and said pipe end holding die is moved against the thrust force of said thrust member as the first sealing tool holding the end portion on the first end side of said profile mother pipe is moved in the axial direction; and the profile mother pipe is formed into a hydraulically bulged and axially press worked product by hydraulic bulging in which an internal pressure load and axial pressing are combined.

6. A hydraulic bulging apparatus for performing axial pressing working to the profile mother pipe according to claim 1 from the first end side where said holding portion is formed, comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe while coupled with said pipe end holding die, the first sealing tool capable of exerting an axial pressing working on the profile mother pipe;

a second sealing tool whose front-end portion is inserted into said die main body in order to hold an end portion on the second end side of said profile mother pipe while coupled with said die main body; and a thrust member which is provided between said die main body and said pipe end holding die, said thrust member imparting thrust force to said pipe end holding die after at least a working fluid is injected, the thrust force facing an end portion of the die main body, wherein an injection hole of the working fluid is provided in either the first sealing tool or the second sealing tool, and wherein during the hydraulic bulging, said pipe end holding die is moved against the thrust force of said thrust member as the first sealing tool holding the end portion on the first end side of said profile mother pipe is moved in the axial direction.

7. The hydraulic bulging apparatus according to claim 6, wherein at least a set of a pair of intermediate holding dies and a thrust member imparting the thrust force to the pair of intermediate holding dies is sequentially arranged between said thrust member imparting the thrust force to said pair of pipe end holding dies and said pair of die main bodies.

8. A hydraulic bulging method, wherein the profile mother pipe according to claim 1 is set in a die of a hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe while coupled with said pipe end holding die;

a second sealing tool whose front-end portion is inserted into said die main body in order to hold an end portion on the second end side of said profile mother pipe while coupled with said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, said pipe end holding die is moved against the thrust force of said thrust member as the first sealing tool holding the end portion on the first end side of said profile mother pipe is moved in the axial direction; and hydraulic bulging in which an internal pressure load and axial pressing are combined is performed to said profile mother pipe.

9. A hydraulic bulging method, wherein the profile mother pipe according to claim 1 is set in a die of a hydraulic bulging apparatus comprising:

a pair of die main bodies;

a pair of pipe end holding dies which is arranged on both end portions on the first end side and second end side of the die main body respectively;

sealing tools which are arranged to insert front-end portions of the sealing tools into said pipe end holding dies in order to hold the first end side and second end side of said profile mother pipe while coupled with said pipe end holding dies respectively, a thrust member which is provided between said die main body and said pipe end holding dies arranged in both the end portions, said thrust member imparting thrust force to said pipe end holding dies after at least a working fluid is injected, the thrust force facing an end portion of the die main body, wherein an injection hole of the working fluid is provided in any one of said sealing tools, and wherein during the hydraulic bulging, said pipe end holding dies are moved against the thrust force of said thrust member as said sealing tools arranged in both the end portions are moved in the axial direction; and hydraulic bulging in which an internal pressure load and axial pressing are combined is performed to said profile mother pipe.

10. A hydraulic bulging method, wherein the profile mother pipe according to claim 1 is produced using a hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe while coupled with said pipe end holding die;

a second sealing tool whose front-end portion is inserted into said die main body in order to hold an end portion on the second end side of said profile mother pipe while coupled with said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, said pipe end holding die is moved against the thrust force of said thrust member as the first sealing tool holding the end portion on the first end side of said profile mother pipe is moved in the axial direction; and hydraulic bulging in which an internal pressure load and axial pressing are combined is performed to said profile mother pipe.

11. A hydraulic bulging method, wherein the profile mother pipe according to claim 1 is produced using a hydraulic bulging apparatus comprising:

a pair of die main bodies;

a pair of pipe end holding dies which is arranged on both end portions on the first end side and second end side of the die main body respectively;

sealing tools which are arranged to insert front-end portions of the sealing tools into said pipe end holding dies in order to hold the first end side and second end side of said profile mother pipe while coupled with said pipe end holding dies respectively, a thrust member which is provided between said die main body and said pipe end holding dies arranged in both the end portions, said thrust member imparting thrust force to said pipe end holding dies after at least a working fluid is injected, the thrust force facing an end portion of the die main body, wherein an injection hole of the working fluid is provided in any one of said sealing tools, and wherein during the hydraulic bulging, said pipe end holding dies are moved against the thrust force of said thrust member as said sealing tools arranged in both the end portions are moved in the axial direction; and hydraulic bulging in which an internal pressure load and axial pressing are combined is performed to said profile mother pipe.

12. A hydraulic bulged and axially press worked product, wherein the profile mother pipe according to claim 1 is set in a die of the hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe while coupled with said pipe end holding die;

a second sealing tool whose front-end portion is inserted into said die main body in order to hold an end portion on the second end side of said profile mother pipe while coupled with said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, said pipe end holding die is moved against the thrust force of said thrust member as the first sealing tool holding the end portion on the first end side of said profile mother pipe is moved in the axial direction; and the profile mother pipe is formed into a hydraulically bulged and axially press worked product by hydraulic bulging in which an internal pressure load and axial pressing are combined.

13. A hydraulic bulged and axially press worked product, wherein the profile mother pipe according to claim 1 is set in a die of the hydraulic bulging apparatus comprising:

a pair of die main bodies;

a pair of pipe end holding dies which is arranged on both end portions on the first end side and second end side of the die main body respectively;

sealing tools which are arranged to insert front-end portions of the sealing tools into said pipe end holding dies in order to hold the first end side and second end side of said profile mother pipe while coupled with said pipe end holding dies respectively, a thrust member which is provided between said die main body and said pipe end holding dies arranged in both the end portions, said thrust member imparting thrust force to said pipe end holding dies after at least a working fluid is injected, the thrust force facing an end portion of the die main body, wherein an injection hole of the working fluid is provided in any one of said sealing tools, and wherein during the hydraulic bulging, said pipe end holding dies are moved against the thrust force of said thrust member as said sealing tools arranged in both the end portions are moved In the axial direction; and the profile mother pipe is formed into a hydraulically bulged and axially press worked product by hydraulic bulging in which an internal pressure load and axial pressing are combined.

14. A hydraulic bulging apparatus for performing axial pressing working to the profile mother pipe according to claim 2 from at least the first end side, comprising:

a pair of die main bodies; a. pair of pipe end holding dies which is arranged on the first end side of the die main body;

a first sealing tool whose front-end portion is inserted into said pipe end holding die in order to hold an end portion on the first end side of said profile mother pipe along with said pipe end holding die, the first sealing tool capable of exerting an axial pressing working on the profile mother pipe;

a second sealing tool in which a parallel portion is provided in an inner surface of the end portion on the second end side in said die main body, the inner surface of the end portion corresponding to a parallel portion of said profile mother pipe, a parallel portion being provided in an outer surface corresponding to the parallel portion of said profile mother pipe to insert a front-end portion of the second sealing tool into said die main body in order to hold an end portion on the second end side of said profile mother pipe along with the parallel portion of said die main body; and a thrust member which is provided between said die main body and said pipe end holding die, said thrust member imparting thrust force to said pipe end holding die after at least a working fluid is injected, the thrust force facing an end portion of the die main body, wherein an injection hole of the working fluid is provided in either the first sealing tool or the second sealing tool, and wherein during the hydraulic bulging, at least the first sealing tool holding the end portion on the first end side of said profile mother pipe is moved in the axial direction, and said pipe end holding die is moved against the thrust force of said thrust member as the first sealing tool holding the end portion on the first end side of said profile mother pipe is moved in the axial direction.

15. The hydraulic bulging apparatus according to claim 14, wherein at least a set of a pair of intermediate holding dies and a trust member imparting the thrust force to the pair of intermediate holding dies is sequentially arranged between said thrust member imparting the thrust force to said pair of pipe end holding dies and said pair of die main bodies.

16. A hydraulic bulging apparatus for performing axial pressing working to the profile mother pipe according to claim 1 from bath end sides with holding portions formed on each of the first and second end sides, comprising:

a pair of die main bodies;

a pair of pipe end holding dies which is arranged on both end portions on the first end side and second end side of the die main body respectively;

sealing tools which are arranged to insert front-end portions of the sealing tools into said pipe end holding dies in order to hold the first end side and second end side of said profile mother pipe while coupled with said pipe end holding dies respectively, each sealing tool capable of exerting an axial pressing working on the profile mother pipe;

a thrust member which is provided between said die main body and said pipe end holding dies arranged in both the end portions, said thrust member imparting thrust force to said pipe end holding dies after at least a working fluid is injected, the thrust force facing an end portion of the die main body, wherein an injection hole of the working fluid is provided in any one of said sealing tools, and wherein during the hydraulic bulging, said pipe end holding dies are moved against the thrust force of said thrust member as said sealing tools arranged in both the end portions are moved in the axial direction.

17. The hydraulic bulging apparatus according to claim 16, wherein at least a set of a pair of intermediate holding dies and a thrust member imparting the trust force to the pair of intermediate holding dies is sequentially arranged between said thrust member imparting the thrust force to said pair of pipe end holding dies and said pair of die main bodies.

18. A hydraulic bulged and axially press worked product, wherein a tapered pipe is set in a die of the hydraulic bulging apparatus comprising:

a pair of die main bodies;

a pair of pipe end holding dies which is arranged on the first end side of the die main body;

a first sealing tool whose front-end portion is inserted into said pipe end holding die in order to hold an end portion on the first end side of said profile mother pipe while coupled with said pipe end holding die;

a second sealing tool whose front-end portion is inserted into said die main body in order to hold an end portion on the second end side of said profile mother pipe while coupled with said die main body; and a trust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, said pipe end holding die is moved against the thrust force of said thrust member as the first sealing tool holding the end portion on the first end side of said profile mother pipe is moved in the axial direction;

producing the profile mother pipe according to claim 1 using the hydraulic bulging apparatus, and further forming said profile mother pipe into a hydraulically bulged and axially press worked product by hydraulic bulging in which an internal pressure load and axial pressing are combined.

19. A hydraulic bulged and axially press worked product, wherein a tapered pipe is set in a die of the hydraulic bulging apparatus comprising:

a pair of die main bodies;

a pair of pipe end holding dies which is arranged on the first end side of the die main body;

a first seating tool whose front-end portion is inserted into said pipe end holding die in order to hold an end portion on the first end side of said profile mother pipe along with said pipe end holding die;

a second sealing tool in which a parallel portion is provided in an inner surface of the end portion on the second end side in said die main body, the inner surface of the end portion corresponding to a parallel portion of said profile mother pipe, a parallel portion being provided in an outer surface corresponding to the parallel portion of said profile mother pipe to insert a front-end portion of the second sealing tool into said die main body in order to hold an end portion on the second end side of said profile mother pipe along with the parallel portion of said die main body; and a thrust member which is provided between said die main body and said pipe end holding die, said thrust member imparting thrust force to said pipe end holding die after at least a working fluid is injected, the thrust force facing an end portion of the die main body;

wherein an injection hole of the working fluid is provided in either the first sealing tool or the second sealing tool, and wherein during the hydraulic bulging, at least the first sealing tool holding the end portion on the first end side of said profile mother pipe is moved in the axial direction, and said pipe end holding die is moved against the thrust force of said thrust member as the first sealing tool holding the end portion on the first end side of said profile mother pipe is moved in the axial direction;

producing the profile mother pipe according to claim 2 using the hydraulic bulging apparatus, and further forming said profile mother pipe into a hydraulically bulged and axially press worked product by hydraulic bulging in which an internal pressure load and axial pressing are combined.

20. A hydraulic bulged and axially press worked product, wherein a tapered pipe is set in a die of the hydraulic bulging apparatus comprising:

a pair of die main bodies;

a pair of pipe end holding dies which is arranged on both end portions on the first end side and second end side of the die main body respectively;

sealing tools which are arranged to insert front-end portions of the sealing tools into said pipe end holding dies in order to hold the first end side and second end side of said profile mother pipe while coupled with said pipe end holding dies respectively, a thrust member which is provided between said die main body and said pipe end holding dies arranged in both the end portions, said thrust member imparting thrust force to said pipe end holding dies after at least a working fluid is injected, the thrust force facing an end portion of the die main body, wherein an injection hole of the working fluid is provided in any one of said sealing tools, and wherein during the hydraulic bulging, said pipe end holding dies are moved against the thrust force of said thrust member as said sealing tools arranged in both the end portions are moved in the axial direction;

producing the profile mother pipe according to claim 1 using the hydraulic bulging apparatus, and further forming said profile mother pipe into a hydraulically bulged and axially press worked product by hydraulic bulging in which an internal pressure load and axial pressing are combined.

* * * * *